US011254079B2

(12) United States Patent
Zwaga et al.

(10) Patent No.: US 11,254,079 B2
(45) Date of Patent: Feb. 22, 2022

(54) METHOD FOR MANUFACTURING AN OBJECT AND PACKAGING

(71) Applicant: Packable B.V., Almelo (NL)

(72) Inventors: Ronald Zwaga, Almelo (NL); Gerrit Arie Buis, Enter (NL); Alain Wietse Bastiaan Tasma, Almelo (NL); Remi De Olde, Almelo (NL)

(73) Assignee: Packable B.V., Almelo (NL)

( * ) Notice: Subject to any disclaimer, the term of this patent is extended or adjusted under 35 U.S.C. 154(b) by 115 days.

(21) Appl. No.: 15/752,068

(22) PCT Filed: Jul. 7, 2016

(86) PCT No.: PCT/EP2016/066093

§ 371 (c)(1),
(2) Date: Feb. 12, 2018

(87) PCT Pub. No.: WO2017/025257

PCT Pub. Date: Feb. 16, 2017

(65) Prior Publication Data

US 2018/0237180 A1 Aug. 23, 2018

(30) Foreign Application Priority Data

Aug. 13, 2015 (EP) ..... 15180975

(51) Int. Cl.
*B31B 50/26* (2017.01)
*B31B 50/22* (2017.01)
(Continued)

(52) U.S. Cl.
CPC ..... *B31B 50/22* (2017.08); *B31B 50/26* (2017.08); *B65D 5/563* (2013.01);
(Continued)

(58) Field of Classification Search
CPC .. B65D 5/4266; B65D 5/563; B65D 77/2024; B65D 2577/205; B65D 2577/2066;
(Continued)

(56) References Cited

U.S. PATENT DOCUMENTS 3,073,440 A * 1/1963 Jones ..... B65D 5/5021 206/429
3,104,012 A * 9/1963 Beamish ..... B65D 77/22 206/438

(Continued)

FOREIGN PATENT DOCUMENTS

| | | | |
|---|---|---|---|
| EP | 0178730 | A2 | 4/1986 |
| EP | 2441697 | A1 | 4/2012 |
| FR | 2975973 | A1 | 12/2012 |
| JP | 200353858 | A | 2/2003 |

*Primary Examiner* — Sameh Tawfik
(74) *Attorney, Agent, or Firm* — The Webb Law Firm

(57) ABSTRACT

A method for manufacturing an object, such as a tray includes providing an unfolded sheet; providing a straight score line in the unfolded sheet for providing a division between a wall part and a flange part; folding the flange part of the sheet relative to the wall part along the score line to provide an angle larger than 45° between the flange part and the wall part; providing a plastic foil; heating the plastic foil; pressing the heated foil on the sheet at the side provided with the score line and covering at least part of the wall part and the flange part; the sheet having at least one U-shaped cut interrupting the score line. The free ends of the U-shaped cut are positioned on the score line. The bridging part of the U-shaped cut is positioned in the flange part.

17 Claims, 5 Drawing Sheets

(51) Int. Cl.

| | |
|---|---|
| ***B65D 77/20*** | (2006.01) |
| ***B65D 5/56*** | (2006.01) |
| *B31B 105/00* | (2017.01) |
| *B31B 110/10* | (2017.01) |
| *B31B 110/35* | (2017.01) |
| *B31B 120/40* | (2017.01) |
| *B65D 5/42* | (2006.01) |

(52) U.S. Cl.
CPC ..... *B65D 77/2024* (2013.01); *B31B 2105/00* (2017.08); *B31B 2110/10* (2017.08); *B31B 2110/35* (2017.08); *B31B 2120/402* (2017.08); *B31B 2120/406* (2017.08); *B65D 5/4266* (2013.01); *B65D 2577/205* (2013.01); *B65D 2577/2066* (2013.01)

(58) Field of Classification Search
CPC . B31B 50/26; B31B 2105/00; B31B 2110/10; B31B 2110/35; B31B 2120/406; B31B 2120/402
USPC ..... 493/51
See application file for complete search history.

(56) References Cited

U.S. PATENT DOCUMENTS

| | | | | | |
|---|---|---|---|---|---|
| 5,253,801 | A * | 10/1993 | Bernstein | B65D 5/20 | 229/110 |
| 7,380,701 | B2 * | 6/2008 | Fogle | B65D 71/34 | 206/431 |
| 7,601,111 | B2 * | 10/2009 | Sutherland | B65D 5/241 | 493/51 |
| 8,011,568 | B2 * | 9/2011 | Maeaettae | B29C 43/203 | 229/407 |
| 8,216,118 | B2 * | 7/2012 | Dunn | B65D 71/36 | 229/117.13 |
| 9,132,935 | B2 * | 9/2015 | Carroll | B65D 5/0254 | |
| 9,254,061 | B2 * | 2/2016 | Harl | B65D 81/3461 | |
| 9,269,872 | B1 * | 2/2016 | Baloglu | H01L 33/52 | |
| 9,701,437 | B2 * | 7/2017 | Bugas | B65D 5/563 | |
| 9,718,576 | B2 * | 8/2017 | Moore | B65D 5/243 | |
| 9,815,585 | B2 * | 11/2017 | Gasior | B65D 5/443 | |
| 10,000,314 | B2 * | 6/2018 | Slack | B65D 25/14 | |
| 2013/0327821 | A1 * | 12/2013 | Zwaga | B65D 5/563 | 229/185.1 |
| 2015/0217884 | A1 * | 8/2015 | Zwaga | B65D 77/2024 | 206/557 |

* cited by examiner

METHOD FOR MANUFACTURING AN OBJECT AND PACKAGING

CROSS-REFERENCE TO RELATED APPLICATIONS

This application is the United States national phase of International Application No. PCT/EP2016/066093 filed Jul. 7, 2016, and claims priority to European Patent Application No. 15180975.3 filed Aug. 13, 2015, the disclosures of which are hereby incorporated in their entirety by reference.

BACKGROUND OF THE INVENTION

Field of the Invention

The invention relates to a method for manufacturing an object, such as a tray, said object having at least a wall and a flange arranged to an edge of said wall and under an angle larger than 45° to said wall, the method comprising the steps of:

- providing an unfolded sheet;
- providing a straight score line in the unfolded sheet for providing a division between a wall part and a flange part and for folding the flange part relative to the wall part;
- folding the flange part of the unfolded sheet relative to the wall part along the score line to provide an angle larger than 45° between the flange part and the wall part;
- providing a plastic foil;
- heating the plastic foil;
- pressing the heated foil on the sheet at the side provided with the score line and covering at least part of the wall part and the flange part.

Description of Related Art

Such a method is known from for example EP 2441697. This method can be used for manufacturing a packaging for modified atmosphere packaging. In such use it is required that the cover foil, which is to be arranged on the circumferential flange after filling the packaging, can be airtight sealed on the flange. With the known method having abutting flange parts, a fully flat flange is obtained covered by a laminated plastic foil, which is easy to attach a cover foil to.

However, the packaging manufactured according to the known method has the tendency to twist, such that the flange no longer is comprised in a flat plane. This is the result of the plastic foil, which is laminated to the sheet at a high temperature. When this laminated foil cools down, it will shrink causing tension between the foil and the sheet, such that the folded flange will be pulled back. As the thickness of the plastic foil varies because the foil is pressed into the packaging to contact all walls, the amount of shrinkage will also vary. As a result, the packaging will be twisted due to the varying tension causing a twisted flange.

When such a packaging is manufactured, filled and closed by a cover foil in line, then the twisted flange could cause malfunction of the in line manufacturing device.

It is therefore an object of the invention to reduce or even remove the above mentioned disadvantages.

SUMMARY OF THE INVENTION

This object is achieved with the method according to the present invention, which method is characterized by at least one U-shaped cut arranged in the sheet interrupting the score line, wherein the free ends of the U-shaped cut are positioned on the score line and wherein the bridging part of the U-shaped cut is positioned in the flange part.

The U-shaped cut provides for a lip to the wall part and a recess in the flange part. When the plastic foil is laminated to the wall part and the flange part and then cools off, the lip of the wall part is pulled into the recess of the flange part by the shrinking plastic. The presence of the lip in the recess provides a locking of the flexibility of the flange part relative to the wall part over the score line. So, after the lip is pulled into the recess by the shrinking plastic foil, the flange part can no longer hinge relative to the wall part, or at least the flexibility of the flange part relative to the wall part is reduced. In case the method is used for manufacturing a packaging with a circumferential flange, this contributes in counteracting the twisting of the flange.

In a preferred embodiment of the method according to the invention the length of each of the legs of the U-shaped cut is equal to the depth of the score line, which is preferably half of the thickness of the unfolded sheet.

A score line in an unfolded sheet provides for a defined folding line. The remaining material at the score line provides a hinge along which the material can be folded. So, the depth of the score line generally defines at what height the folded flange part will be relative to the top edge of the wall part.

Now by having the length of the legs of the U-shaped cut being equal to the depth of the score line, will provide a lip extending over the same height as the flange part will be relative to the top edge of the wall part. So, the upper edge of the lip will be more or less at the same level as the top surface of the flange part.

When the plastic foil laminated to the wall part and the flange part shrinks, the lip will provide a wall against which the recess of the flange part can be pulled against providing a solid locking of the flange part relative to the wall part.

In another embodiment of the method according to the invention the flange part of the unfolded sheet is folded relative to the wall part to an angle larger than a desired resulting angle and is maintained at said larger angle when the heated foil is pressed on the sheet.

Because the U-shaped cut does not span the full length of the folding line, only parts of the folding line are locked and other parts are provided with the score line. Depending on the plastic foil used, the effect of shrinkage of the plastic foil in the region of the score line could still provide such tension, that still parts of the flange part will wobble and will not be as flat as the parts round the U-shaped cut. By folding the flange part over an angle large than desired and then laminating the plastic foil over the wall part and the flange part, the effect of the shrinking plastic foil can be compensated, such that the resulting angle between flange part and wall part will approach the desired angle.

The invention further relates to a packaging manufactured with the method according to the invention comprising:

- a box folded from a sheet comprising a bottom, upstanding wall parts arranged along the circumference of the bottom and horizontal flange parts arranged to the top edges of the wall parts along a score line, wherein adjacent flange parts abut to compose an endless circumferential flange; and
- a plastic foil laminated to the inner wall of the box, wherein the plastic foil extends over the circumferential flange to substantially cover the flange and wherein adjacent wall parts of the box abut and are fixated in position by the laminated plastic foil, characterized in that the top edge of each wall part comprises at least one lip protruding in the plane of the wall part;

each adjacent flange part comprises a recess facing the lip of the corresponding wall part, wherein the width of the recess corresponds with the width of the lip and wherein the lip and recess are provided by a U-shaped cut arranged interrupting the score line.

The lip of the wall part will be pulled into the recess, when the laminated plastic foil cools off and shrinks, providing a lock for the flange part relative to the wall part.

In a preferred embodiment of the packaging according to the invention the leading edge of the at least one lip is positioned in or below the top surface of the adjacent flange part.

This ensures that the top surface of the circumferential flange will not be interrupted by protruding leading edges of the lips.

In yet another embodiment of the packaging according to the invention, the abutting sides of the flange parts extend at the score line beyond the abutting sides of the corresponding wall parts.

Preferably, the extension at the score line of the flange parts relative to the wall parts is equal to the depth of the score line.

When the flange part is folded along the score line relative to the wall part, the flange part will shift relative to the wall part as the hinge is provided by the remaining material under the score line. This shift could cause a gap between adjacent flange parts, especially in corners of the packaging. Such gaps will weaken the flange such that any tension caused by the shrinking plastic foil could more easily result in distortion of the flat circumferential flange.

Now by extending the flange part a bit relative to the wall part at the score line, it will be more easy to have the flange parts to abut when the plastic foil is laminated. As no gap is present, the change on any distortion of the circumferential flange will be reduced.

The additional features of this embodiment could also be used on a packaging according to the prior art.

Yet another preferred embodiment of the packaging according to the invention further comprises:

a cover foil sealed to the laminated plastic foil along the circumferential flange;

a tab arranged to the circumferential flange;

wherein the laminated foil substantially covers and is attached to the tab and wherein the cover foil has a tab portion, which only partially covers the tab and is loose from the underlying laminated foil.

When a user wants to open the packaging, the user will be prompted by the tab to hold the packaging there. As the laminating foil is attached to the tab, the user will both hold the laminating foil and the tab. Because further, the tab portion of the cover foil is loose from the laminating foil, the user can easily peel of the cover foil, without tearing the laminating foil from the folded sheet.

BRIEF DESCRIPTION OF THE DRAWINGS

The additional features of this embodiment could also be used on a packaging according to the prior art.

DESCRIPTION OF THE INVENTION

Figure 1A:
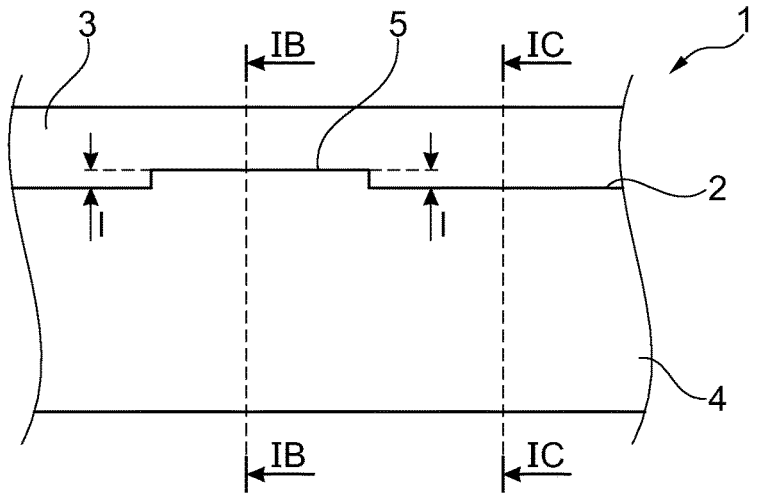
FIGS. 1A-1D show steps of a first embodiment of the method according to the invention.

FIG. 1A shows a view of an unfolded sheet 1. A straight score line 2 is arranged in the unfolded sheet 1 to provide a flange part 3 and a wall part 4. The score line 2 is interrupted by a U-shaped cut 5 of which the free ends of the U-shaped cut 5 are positioned on the score line 2 and wherein the bridging part of the U-shaped cut is positioned in the flange part 3.

The unfolded sheet 1 is then folded, such that the flange part 3 is folded relative to the wall part 4.

Figure 1B:
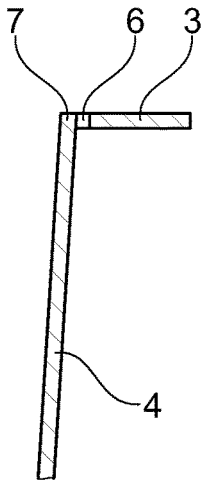

As shown in FIG. 1B, by folding the flange part 3 a recess 6 is provided due to the U-shaped cut 5 as well as a lip 7, which is positioned in front of the recess 6.

Figure 1C:
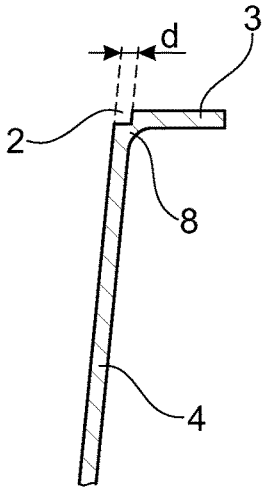

FIG. 1C shows a cross section along a part with a score line 2. By folding the flange part 3 relative to the wall part 4, the score line 2 will open up and the remaining material 8 at the score line 2 will act as a hinge.

By choosing the length 1 of the legs of the U-shaped cut 5 equal to the depth d of the score line 2, it is ensured that the leading edge of the lip 7 does not extend beyond the top surface of the flange part 3.

Figure 1D:
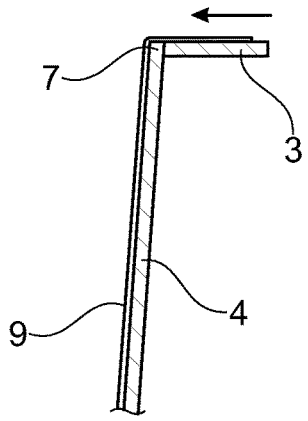

Finally, a plastic foil 9 is heated and pressed on the wall part 4 and the flange part 3 on the side of the score line 2. It should be understood that plastic foil is plastic and does not include metal. When the plastic foil 9 cools down, the foil 9 will shrink and pull the flange part 3 against the lip 7 to lock the flange part 3 in the horizontal position relative to the wall part 4 as shown in FIG. 1D.

Figure 2A:
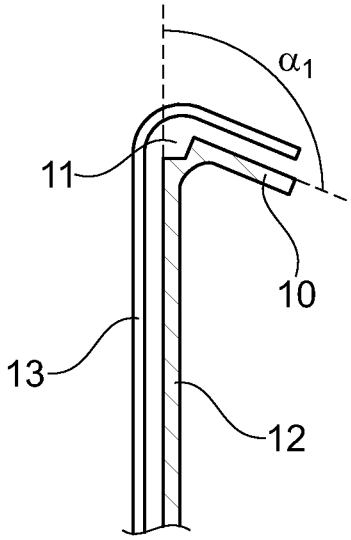
FIGS. 2A and 2B show steps of a second embodiment of the method according to the invention.

FIG. 2A shows a step of a second embodiment of the method according to the invention. In this step the flange part 10 is folded along the score line 11 relative to a wall part 12 to an angle $\alpha_1$, which is larger than a desired angle $\alpha_2$.

Figure 2B:
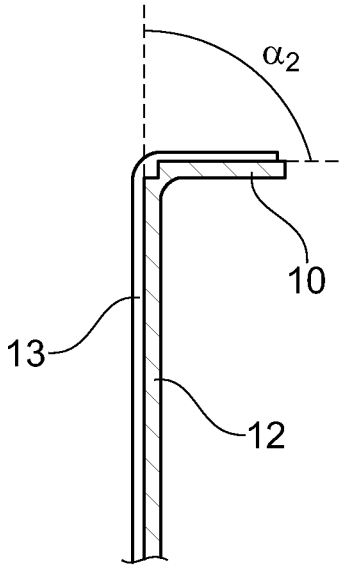

A heated foil 13 is laminated to the wall part 12 and the flange part 10. When the foil 13 cools down, the shrinkage will pull the flange part 10 back to a desired angle $\alpha_2$ as shown in FIG. 2B. As a result, the flange part 10 will be horizontal even at the parts not having a locking due to a U-shaped cut.

Figure 3:
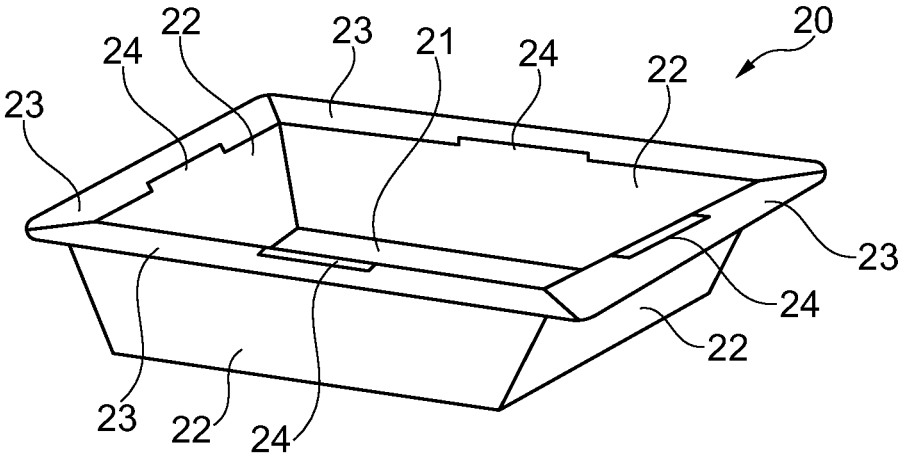
FIG. 3 shows a perspective view of a first embodiment of the packaging according to the invention.

FIG. 3 shows a perspective view of a first embodiment of the packaging 20 according to the invention. The packaging 20 has a bottom 21, wall parts 22 arranged along the circumference of the bottom 21 and flange parts 23 arranged on the top edge of the wall parts 22.

Each wall part 22 and flange part 23 combination are manufactured with a U-shaped cut, as shown in FIGS. 1A-1D, such that a lip 24 is provided on the wall part 22. By laminating a heated foil on the inside of the packaging 20, the flange part 23 is pulled against the lip 24 and the flange parts 23 are locked in their horizontal position.

Figure 4:
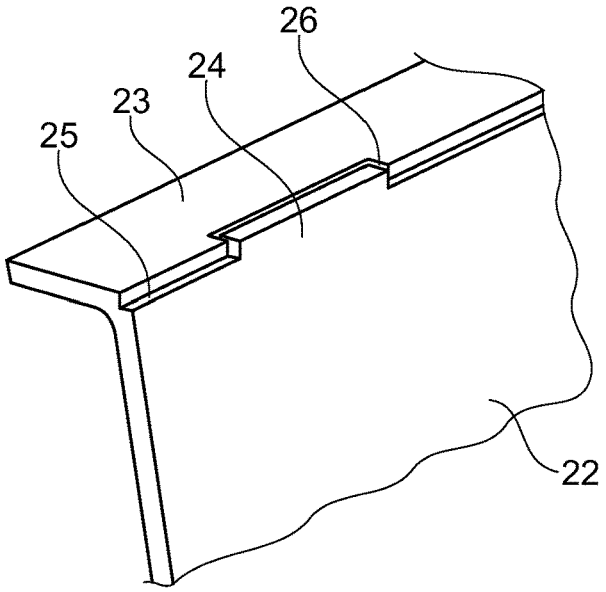
FIG. 4 shows a perspective view of a detail of the packaging according to FIG. 3.

FIG. 4 shows a perspective view of a detail of the packaging 20. The flange part 23 is folded along the score line 25 relative to the wall part 22. The lip 24 provided by the U-shaped cut is accommodated in the recess 26, such that the flange part 23 will be locked relative to the wall part 22.

Figure 5:
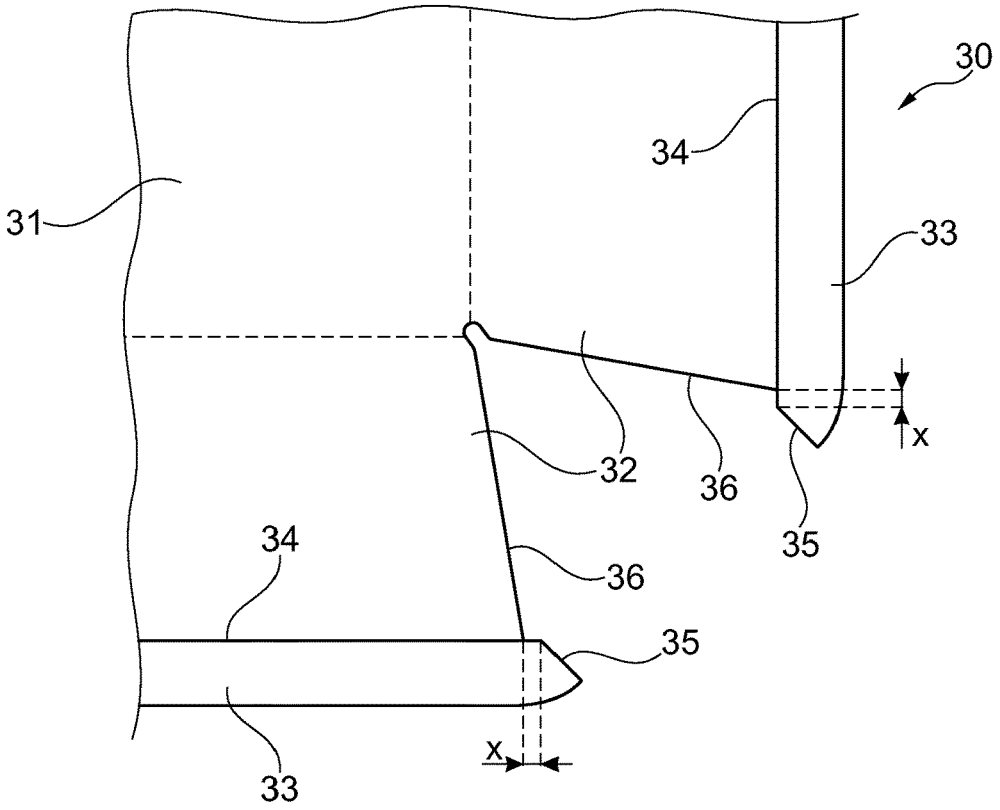
FIG. 5 shows an unfolded sheet for a second embodiment of a packaging according to the invention.

FIG. 5 shows an unfolded sheet 30 for a second embodiment of a packaging according to the invention. The unfolded sheet 30 has a bottom region 31 with two wall parts 32 bordering the bottom region 31. At the top edge of the wall parts 32, flange parts 33 are arranged along a score line 34.

The abutting sides 35 of the flange parts 33 extend at the score line 34 beyond the abutting sides 36 of the corresponding wall parts 32 over a distance x. Preferably, the distance x is more or less half of the thickness of the unfolded sheet 30.

Figure 6:
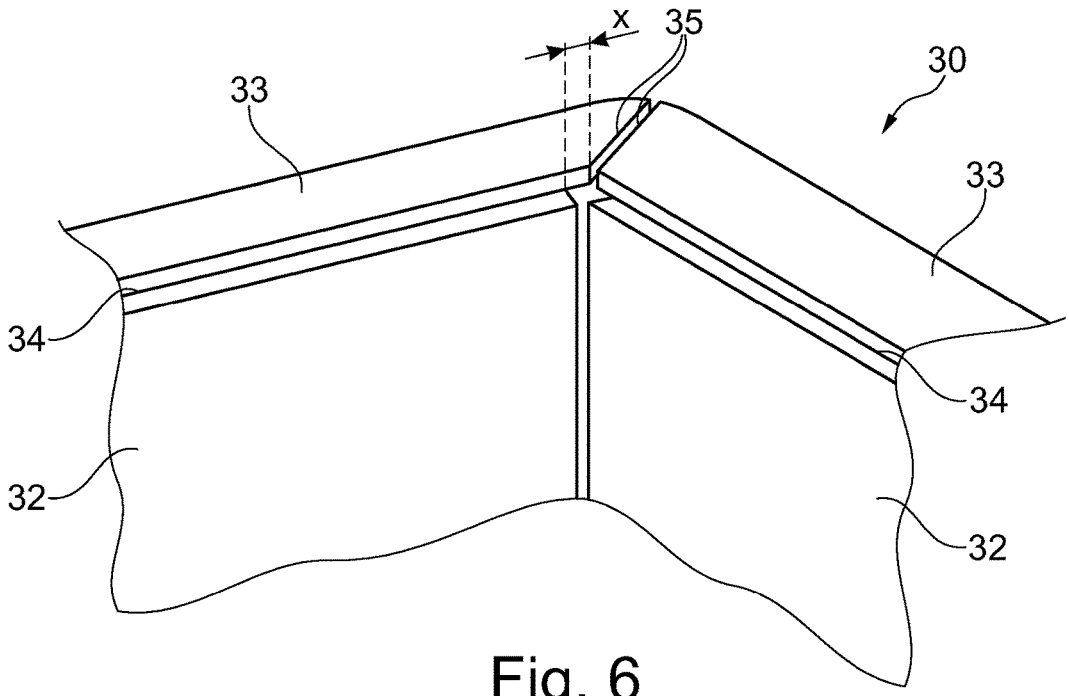
FIG. 6 shows a perspective view of a detail of a packaging folded out of the sheet shown in FIG. 5.

FIG. 6 shows a perspective view of a detail of a packaging folded out of the sheet 30 shown in FIG. 5. The flange parts 33 are folded along the score lines 34 relative to the wall parts 32. Due to the depth of the score line 34, the flange parts 33 will move back a little, such that the abutting sides 35 of the flange parts would be at a distance. However, by providing the extension over the distance x, the abutting sides 35 will still meet.

Figure 7:
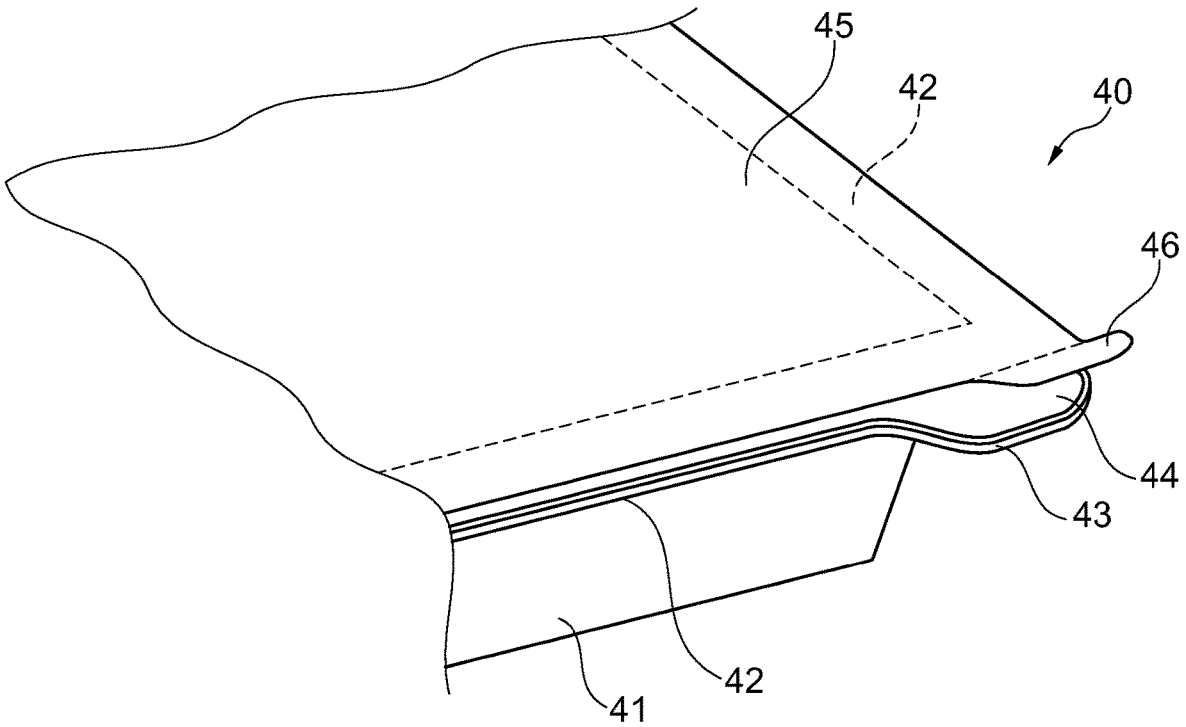
FIG. 7 shows a perspective view of a third embodiment of a packaging according to the invention.

FIG. 7 shows a perspective view of a third embodiment of a packaging 40 according to the invention.

This packaging has a bottom, upstanding wall parts 41 and flange parts 42. One of the flange parts 42 is provided with a tab 43, which is covered by the laminating foil 44.

After filling of the packaging 40, a cover foil 45 is sealed to the flange parts 42 to close the packaging 40 airtight. The cover foil 45 is provided with a tab 46 which only partially covers the tab 43 and is loose from the underlying laminated foil 44.

Figure 8A:
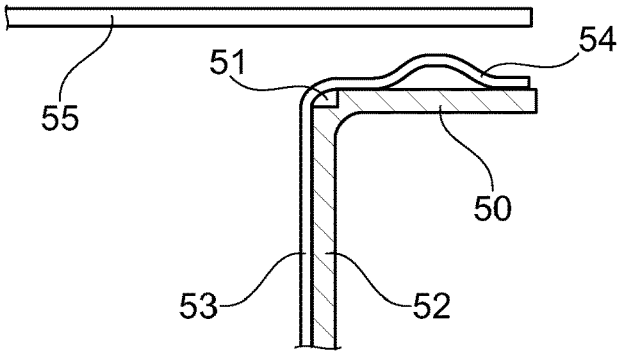
FIGS. 8A-8C show steps of a third embodiment of the method according to the invention.

FIG. 8A shows a step of a third embodiment of the method according to the invention. In this step a flange part 50 is folded along a score line 51 relative to a wall part 52. A plastic foil 53 is laminated over the wall part 52 and the flange part 50. At the flange part 50, the plastic foil 53 is provided with a bulge 54, where the plastic foil 53 is locally not attached to the underlying flange part 50.

Figure 8B:
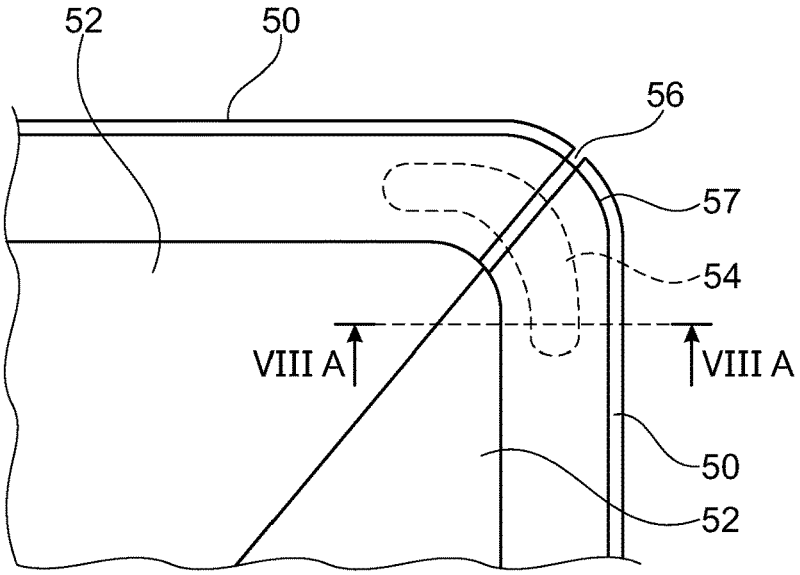

FIG. 8B shows a top view of FIG. 8A. The bulge 54 extends in this embodiment over the corner embodied by two flange parts 50. When folding the flange parts 50 together, a space 56 could be present in the corner. When the plastic foil 53 is fully laminated over this space 56, the foil 53 could sag into the space 56 providing a channel. When a cover foil 55 is laminated over the channel, the complete package will not be airtight and will leak over the created channel.

A solution for this problem is already provided by EP 2687360 of the applicant. In this publication the plastic foil is not fully attached to the flange parts, such that a loose lip is provided. Only after sealing the cover foil to the packaging, the plastic foil will be fully adhering to the flange parts.

However, due to the thin plastic foil typically used when laminating the flange parts, it could occur, that the loose lip curls back, for example due to the heat present during the manufacturing method. When the loose lip is curled back and subsequently a cover foil is pressed on the flange parts, the cover foil will not be properly be sealed due to the curled back lip.

This problem is solved by adhering the edge of the loose lip also to the flange part, such that a bulge or tunnel like structure is provided in the plastic foil laminated on the flange.

By providing a bulge 54, where the plastic foil 53 is not yet attached to the flange parts 50, the space 54 is bridged and the creation of a channel is prevented. Furthermore, the edge 57 of the plastic foil cannot curl back, as the edge 57 is attached to the flange part 50. So, by providing a bulge 54, a ridge or the like curling back of the loose edge, such as described by EP 2687360 is prevented.

Figure 8C:
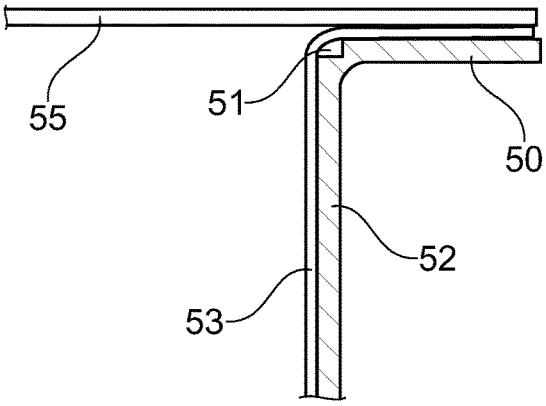

In FIG. 8C, a cover foil 55 is moved over the flange 50 and pressed thereon to seal the cover foil 55 to the laminated plastic foil 53. Due to the bulge 54, a reliable contact between the plastic foil 53 and the cover foil 55 is obtained, such that any leakage due to a faulty seal is prevented. Due to the sealing action, the part of the plastic foil 53, which was not attached to the flange parts 50 during the step shown in FIGS. 8A and 8B, will be adhered to the underlying flange parts 50.

The invention claimed is:

1. A method for manufacturing an object having at least a wall and a flange arranged to an edge of said wall and under an angle larger than 45° to said wall, the method comprising:

providing an unfolded sheet;

providing a straight score line in the unfolded sheet for providing a division between a wall part and a flange part and for folding the flange part relative to the wall part, wherein the unfolded sheet includes at least one U-shaped cut arranged in the sheet interrupting the score line, wherein free ends of the U-shaped cut are positioned on the score line and wherein a bridging part of the U-shaped cut is positioned in the flange part;

folding the flange part of the unfolded sheet relative to the wall part along the score line to provide an angle larger than 45° between the flange part and the wall part thereby defining a recess due to the U-shaped cut as well as a lip, which is positioned in front of the recess;

providing a plastic foil;

heating the plastic foil; and pressing the heated foil on the sheet at a side provided with the score line and covering at least part of the wall part, the flange part and at least one U-shaped cut, such that when the heated plastic foil cools the foil will shrink and pull the lip of the wall part into the recess to accommodate the lip in the recess to provide a locking of the flexibility of the flange part relative to the wall part over the score line such that the wall part in the region of the U-shaped cut is deformed to provide additional structural stiffness.

2. The method according to claim 1, wherein a length of each leg of the U-shaped cut is equal to a depth of the score line.

3. The method according to claim 2, wherein the depth is half of a thickness of the unfolded sheet.

4. The method according to claim 2, wherein the flange part of the unfolded sheet is folded relative to the wall part to an angle larger than a desired resulting angle and is maintained at said larger angle when the heated foil is pressed on the sheet.

5. The method according to claim 1, wherein the flange part of the unfolded sheet is folded relative to the wall part to an angle larger than a desired resulting angle and is maintained at said larger angle when the heated foil is pressed on the sheet.

6. A packaging manufactured with the method according to claim 1, comprising:

a box folded from a sheet comprising a bottom, upstanding wall parts arranged along a circumference of the bottom and horizontal flange parts arranged to top edges of the wall parts along a score line, wherein adjacent flange parts abut to compose an endless circumferential flange; and a plastic foil laminated to an inner wall of the box, wherein the plastic foil extends over the circumferential flange to substantially cover the flange and wherein adjacent wall parts of the box abut and are fixated in position by the laminated plastic foil, wherein the top edge of each wall part comprises at least one lip protruding in a plane of the wall part;

each adjacent flange part comprises a recess facing the lip of the corresponding wall part, wherein the width of the recess corresponds with the width of the lip and wherein the lip and recess are provided by a U-shaped cut arranged interrupting the score line.

7. The packaging according to claim 6, wherein a leading edge of the at least one lip is positioned in or below a top surface of the adjacent flange part.

8. The packaging according to claim 7, wherein the abutting sides of the flange parts extend at the score line beyond the abutting sides of the corresponding wall parts.

9. The packaging according to claim 7, further comprising:

a cover foil sealed to the laminated plastic foil along the circumferential flange;

a tab arranged to the circumferential flange;

wherein the laminated foil substantially covers and is attached to the tab and wherein the cover foil has a tab portion, which only partially covers the tab and is loose from the underlying laminated foil.

10. The packaging according to claim 6, wherein the abutting sides of the flange parts extend at the score line beyond the abutting sides of the corresponding wall parts.

11. The packaging according to claim 10, wherein the extension at the score line of the flange parts relative to the wall parts is equal to the depth of the score line.

12. The packaging according to claim 11, further comprising:

a cover foil sealed to the laminated plastic foil along the circumferential flange;

a tab arranged to the circumferential flange;

wherein the laminated foil substantially covers and is attached to the tab and wherein the cover foil has a tab portion, which only partially covers the tab and is loose from the underlying laminated foil.

13. The packaging according to claim 10, further comprising:

a cover foil sealed to the laminated plastic foil along the circumferential flange;

a tab arranged to the circumferential flange;

wherein the laminated foil substantially covers and is attached to the tab and wherein the cover foil has a tab portion, which only partially covers the tab and is loose from the underlying laminated foil.

14. The packaging according to claim 6, further comprising:

a cover foil sealed to the laminated plastic foil along the circumferential flange;

a tab arranged to the circumferential flange;

wherein the laminated foil substantially covers and is attached to the tab and wherein the cover foil has a tab portion, which only partially covers the tab and is loose from the underlying laminated foil.

15. The method according to claim 1, wherein the object comprises a tray.

16. The method according to claim 1, wherein the shrinking foil holds and deforms the lip into the recess such that the flange part can no longer hinge relative to the wall part, or at least the flexibility of the flange part relative to the wall part is reduced to provide additional structural stiffness.

17. The method according to claim 1, wherein after the flange part is folded, the foil will shrink and only the foil will pull the flange part and lip together.

* * * * *